US010028058B2

(12) United States Patent
Anderson

(10) Patent No.: US 10,028,058 B2
(45) Date of Patent: Jul. 17, 2018

(54) VSR SURROUND SOUND TUBE HEADPHONE

(75) Inventor: Yul Lavauno Anderson, Vallejo, CA (US)

(73) Assignee: Yul Anderson, Vallejo, CA (US)

( * ) Notice: Subject to any disclaimer, the term of this patent is extended or adjusted under 35 U.S.C. 154(b) by 13 days.

(21) Appl. No.: 10/592,576

(22) PCT Filed: Jan. 14, 2004

(86) PCT No.: PCT/EP2003/013491
§ 371 (c)(1),
(2), (4) Date: Sep. 13, 2006

(87) PCT Pub. No.: WO2005/053354
PCT Pub. Date: Jun. 9, 2005

(65) Prior Publication Data

US 2007/0280484 A1 Dec. 6, 2007

(30) Foreign Application Priority Data

Nov. 27, 2003 (DK) ..... 2003 01776

(51) Int. Cl.
*H04R 1/10* (2006.01)
*H04R 5/033* (2006.01)

(52) U.S. Cl.
CPC ..... *H04R 5/0335* (2013.01); *H04R 2205/024* (2013.01)

(58) Field of Classification Search
CPC ..... H04R 5/0335; H04R 2205/024
USPC ..... 381/74, 370, 376, 72
See application file for complete search history.

(56) References Cited

U.S. PATENT DOCUMENTS

| | | | | |
|---|---|---|---|---|
| 4,110,583 | A * | 8/1978 | Lepper | 381/382 |
| 5,680,465 | A * | 10/1997 | Boyden | 381/309 |
| 6,611,212 | B1 * | 8/2003 | Craven et al. | 341/50 |
| 2003/0103637 | A1 * | 6/2003 | Huang | 381/309 |

* cited by examiner

*Primary Examiner* — Paul S Kim
(74) *Attorney, Agent, or Firm* — Yul Anderson; Y. A. Enterprise

(57) ABSTRACT

A Closed Loop Headphone Apparatus with 1, 2, 3, 4, 5, 6, 7 or more built-in speakers and 2 Ear Openings, which go around the head of the user and imparting real surround sound emitted from each ear opening.

3 Claims, 2 Drawing Sheets

VSR SURROUND SOUND TUBE HEADPHONE

DESCRIPTION

Figure 1:
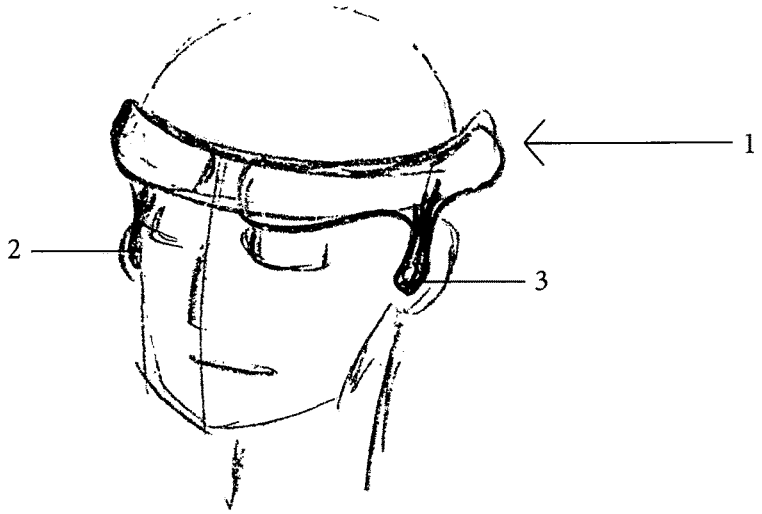
FIGS. 1—the view of how the preferred embodiment of the present invention fits around the head of a user 1 with two audio receptors 2, 3.

As shown in the figures, the present invention is a tubular headphone, an apparatus for hearing multi-channel audio content through 3, 4, 5, 6, or 7 or more speakers located within or without a tube which fits around the head with 2 openings for audio reception in the left and right ear receiving sound input from the tube acoustics' audio production output from infrared, wireless, audio signal or wire connection to digital, analog or any audio production process i.e. receiver, amplifiers, or any device producing sound frequency.

The tube like headphone apparatus fits around the head with 3 to 7 or more speakers separately connecting to a multi-channel audio output.

The Surround Sound Tube Headphone System has 2 or more multi-channel speakers within a tube which fits around the head with 2 opening for the left and right ear audio reception.

The tubular audio reception device can be worn around the head and contains 2 or more speakers within or without the diameter of the tube.

The Surround Sound Tube Headphone System audio reception acoustic quality can vary depending on the kind of tubing material used i.e. wood, plastic, rubber, cardboard etc.

The audio reception can be received through different size tubing connecting to directly from the speakers within separate tubing sections in front and rear of the head to the left and right ear.

The headphone can also have a built-in 5.1 converter which allow normal 2.0 output to be converted into 5.1 when using the VSR Surround Sound Tube Headphone. This is done by use of Mp2 and AC3 decoder broadcast system. Thus, the 5.1 VSR Surround Sound Tube Headphones could also convert the 2.0 signal into a 5.1 signal. This is one technical specification of the more advance Surround Sound Tube Headphone System models.

The VSR Surround Sound Tube Headphone is the first portable 5.1 audio device ever invented. In essence, it enables the consumer to transport 5.1 Home Theatre experience anywhere and everywhere opening the floodgates to high quality portable audio/visual consumer electronical devices not yet existing including a 5.1 portable DVD/Receiver.

As the material of the Surround Sound Tube Headphone System changes with technological advancement of new "sound perspectives" a "real life" sound output and content is found with acoustics reflecting environmental material which is reflected in the tubing material. The acoustical environment and sound content of the Surround Sound Tube Headphone System are therefore genuine Microcosms or miniature versions of the 5.1 6.1 7.1 or more speaker set-up found in the living room, studios, or rooms capturing authentic, real life and concerted sound experiences recorded in 5.1, 6.1, 7.1 or more multi-channel and used by those who have a standard 5.1 DTS or 5.1 Dolby Surround Sound amplifier.

Method and tubular headphone apparatus for hearing multi-channel audio content through 3, 4, 5, 6, or 7 or more speakers located within or without a tube which fits around the head with 2 openings for audio reception in the left and right ear receiving sound input from the tube acoustics' audio production output from infrared, wireless, audio signal or wire connection to digital, analog or any audio production process i.e. receiver, amplifiers, or any device producing sound frequency.

A ear apparatus in which conduction by sounds takes place through a vacuum or a audio content medium within a sealed tube and which has various uses based on the controlled flow of sounds.

The VSR Surround Sound Tube Headphone "5-6-7 speakers are separately connected to each speaker channel input of the 5.1, 6.1 or 7.1 receiver or amplifier. These channels coincide with the speakers placement within or without the diameter of the tube. For example, located on the forehead of the tube is the CS (center speaker), to the left of the forehead is the FLS (front left speaker) to the right of the forehead is the FRS (front right speaker), in the back left side of the tube is the BLS (back left speaker) in the back right side of the tube is the BRS (back right speaker) the sub-bass miniature speaker is located in the front under the CS.

An acoustical sounds tube in which audio content passes through 3, 4, 5, 6, 7 or more speakers producing surround sound duplicating 5.1, 6.1, 7.1 speaker set-up in a living room, studio or movie theatre.

A tube like headphone apparatus that fits around the head with 3 to 7 or more speakers separately connecting to a multi-channel audio output.

Authentic 2 or more multi-channel speakers within a tube which fits around the head with 2 opening for the left and right ear audio reception.

A tubular audio reception device worn around the head containing 2 or more speakers within or without the diameter of the tube—usually used in plural.

The Surround Sound Tube Headphone System apparatus function can carry audio content and create authentic 5.1, 6.1, 7.1 audio reception from speakers output from 3, 4, 5, 6, or 7 or more speakers located within or without the diameter of a tube fitting around the head or in separate parts located in front, side and back of the head and connected to audio reception tubing connecting to and bringing audio content to the left and right ear of the listener. The audio content quality can be changed or varied depending on the size, shape and material used.

The Surround Sound Tube Headphone System apparatus can carry audio content carried through tubing connected to tubing containing 3, 4, 5, 6, 7, or more multi-channel speakers bringing audio content to the right and left hear located around and about the head.

Location of the multi-channel speakers in the tubing can create authentic surround sound audio content reception equal to, similar to, or reflecting that of 5.1, 6.1, 7.1 speaker set-up in a room (see illustration below).

The Surround Sound Tube Headphone System is the only headphone apparatus that claims that the location of multi-channel speakers in the tubing can create authentic surround sound audio content reception equal to, similar to, or reflecting that of 5.1, 6.1, 7.1 speaker set-up in a room.

The Surround Sound Tube Headphone System is the only headphone known and that can claim to be authentic surround sound audio reception carrying 5.1, 6.1, 7.1 or more audio content similar to a 5.1, 6.1, 7.1 speakers set-up in a room. Therefore, is the most authentic and true sounding headphone system to the home multi-channel speaker set-up in a room.

The Surround Sound Tube Headphone System is the type of headphone that has 3, 4, 5, 6, 7 or more real speakers located within or without the diameter of a tube carrying audio content from a 5.1, 6.1, 7.1 or more receiver, amplifier, or any other audio output and can be used for exception sound quality with normal stereo output also.

No other Surround Sound Headphone System can claim 4.1 5.1, 6.1, 7.1 or more audio output from a multichannel of 3, 4, 5, 6, 7 or more speakers located within a tube which brings authentic surround sound reception to the ears similar to and no different than that of a surround sound speaker system set-up in a room, studio, or sound environment.

Each speaker within or without the diameter of the tubing is connected to separate wires that connect to there related multi-channels (front right, front left, center, back right and back left, and addition sub-woofer) of the 5.1 amplifier or receiver speaker output.

Any method using a tubing apparatus that goes around the head with 3, 4, 5, 6, 7, or more speakers connected by wire, infrared, or by wireless or any other sound transmitting technology that receives multi-channel 5.1, 6.1, 7.1 surround sound audio content or signals from a 5.1 amplifier or receiver.

Figure 2:
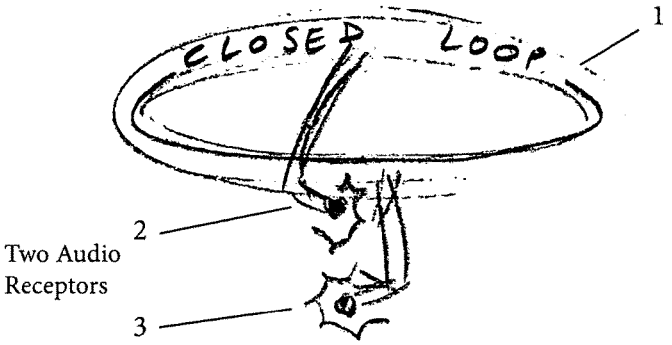
FIG. 2—a closed loop shaped tube with two audio receptors where 3—the right ear opening in a tube for bringing sound from all speakers into the ear; 2—left ear opening in a tube for bringing sound from all speakers into the right ear.
Figure 3:
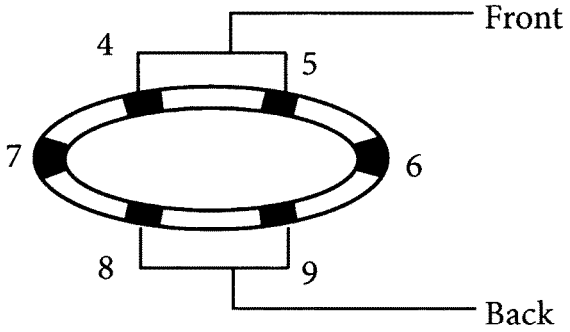
FIG. 3—the preferred embodiment of the location of six speakers round and about the closed loop where the front left is 4, front right is 5, center left is 7, center right is 6, back left is 8, and back right is 9.
Figure 4:
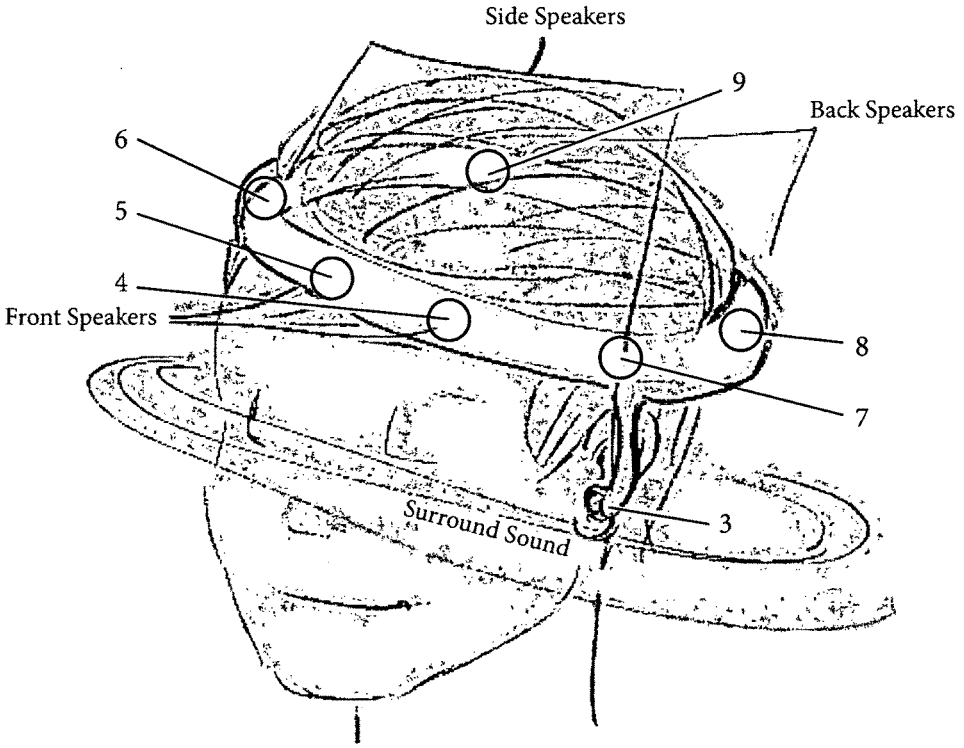
FIG. 4—the view of how the preferred embodiment of the present invention fits around the head of a user and the how six speakers 4, 5, 6, 7, 8 are located inside the closed loop and the left ear opening 3.
Figure 5:
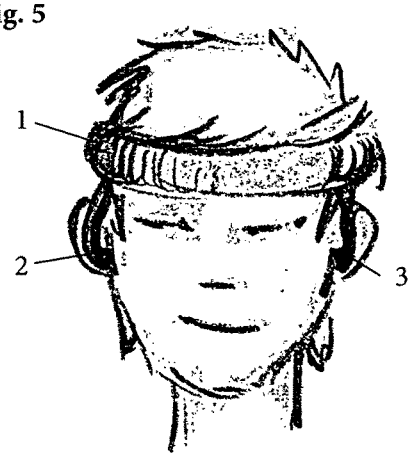
FIG. 5 the front view of how the preferred embodiment of the present invention fits around the head of a user 1 with two ear openings 2, 3.
Figure 6:
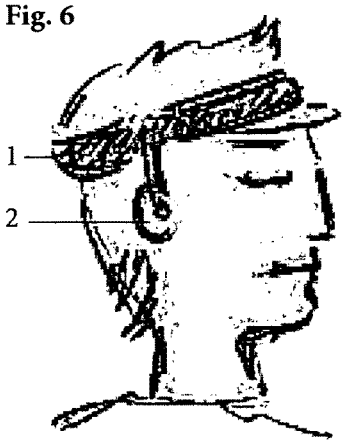
FIG. 6—the side view of how the preferred embodiment of the present invention fits around the head of a user with right ear opening 2.
Figure 7:
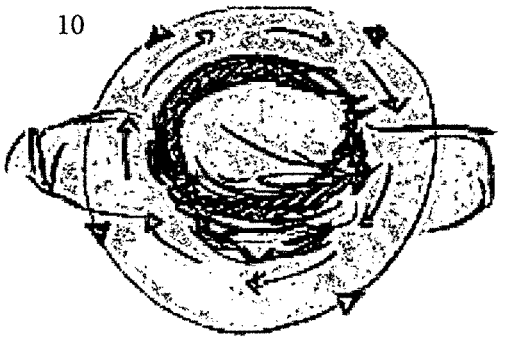
FIG. 7—the top view of how the preferred embodiment of the present invention fits around the head of a user and the view of how the speakers bring the surround sound 10.

FIG. 2 shows multiple speakers located in the tubing. Each speaker is connected to a different channel of the multi-channel 5.1 amplifier or receiver. One or two earphones may receive sound content from the amplifier.

The invention claimed is:

1. A circular headphone apparatus comprising a closed loop shaped tube that fits around the head of a user reproducing 3D surround with 3 or more separate channels; and at least 3 built-in speakers that receive sound from a receiver, amplifiers or any sound producing device; and separately connecting to a multi-channel audio output or audio player where all speakers emit sound inside the closed loop of the tubular circular headphone; and two ear openings in said tube for bringing said output sound from all speakers into left and right ear of the user; and wherein said tube forms a closed loop, wherein at least three or more speakers can be located in the front right, front left, side right, side left and back right, back left of the head, where different parts of the audio of the recording can be heard through the different speakers connected to different channels, whereas the speakers' sound emission comes from the front, side and back separately connected to a multichannel receiver with front, side and back multichannel audio output or audio player; and at least 3 speakers which are the center speaker located on the forehead of the tube and to the left of the forehead is the FLS front left speaker; to the right of the forehead is the FRS front right speaker, in the back left side of the tube is the BLS back left speaker, in the back right side of the tube is the BRS back right speaker and a sub-bass miniature speaker is located in the front under the center speaker.

2. The headphone apparatus according to claim 1, wherein the said tube is constructed of a material selected from the group of wood, plastic, rubber, cardboard and any combination and alloy.

3. The headphone apparatus according to claim 1, further comprising a built-in 5.1 converter, which allows normal 2.0 output to be converted into 5.1, wherein each speaker inside the tube is connected to a different channel in the receiver and each speaker plays different parts of the audio; and all channels can be heard in each ear opening.

* * * * *